US008240583B2

(12) United States Patent
Cristina

(10) Patent No.: US 8,240,583 B2
(45) Date of Patent: Aug. 14, 2012

(54) SHOWER HEAD

(75) Inventor: Alberto Cristina, Milan (IT)

(73) Assignee: CRS S.p.A., Milan (IT)

( * ) Notice: Subject to any disclaimer, the term of this patent is extended or adjusted under 35 U.S.C. 154(b) by 201 days.

(21) Appl. No.: 12/293,956

(22) PCT Filed: Mar. 30, 2007

(86) PCT No.: PCT/IT2007/000243

§ 371 (c)(1),
(2), (4) Date: Sep. 22, 2008

(87) PCT Pub. No.: WO2007/113889

PCT Pub. Date: Oct. 11, 2007

(65) Prior Publication Data

US 2009/0200404 A1 Aug. 13, 2009

Related U.S. Application Data

(63) Continuation of application No. PCT/IT2006/000207, filed on Mar. 31, 2006.

(51) Int. Cl.

| | |
|---|---|
| ***B05B 1/30*** | (2006.01) |
| ***B05B 1/00*** | (2006.01) |
| ***B05B 1/34*** | (2006.01) |
| ***A62C 2/08*** | (2006.01) |
| ***A62C 31/02*** | (2006.01) |

(52) U.S. Cl. ..... 239/533.14; 239/533.13; 239/548; 239/589; 239/596; 239/600; 239/602

(58) Field of Classification Search ..... 239/533.13, 239/533.14, 548, 552, 553, 553.3, 553.5, 239/555, 562, 589, 590.3, 596, 600, 602
See application file for complete search history.

(56) References Cited

U.S. PATENT DOCUMENTS

| | | | | |
|---|---|---|---|---|
| 2,874,001 | A * | 2/1959 | Webb | 239/533.14 |
| 5,228,625 | A * | 7/1993 | Grassberger | 239/558 |
| 6,227,696 | B1 | 5/2001 | Duchnowski et al. | |
| 6,250,572 | B1 * | 6/2001 | Chen | 239/602 |
| 6,382,531 | B1 | 5/2002 | Tracy | |
| 6,641,057 | B2 * | 11/2003 | Thomas et al. | 239/104 |
| 6,739,527 | B1 | 5/2004 | Chung | |
| D528,631 | S | 9/2006 | Gillette et al. | |
| 7,143,897 | B1 | 12/2006 | Guzman et al. | |
| 7,537,175 | B2 | 5/2009 | Miura et al. | |
| 7,721,979 | B2 * | 5/2010 | Mazzola | 239/533.14 |
| 2005/0284967 | A1 | 12/2005 | Korb et al. | |
| 2006/0163391 | A1 * | 7/2006 | Schorn | 239/596 |

FOREIGN PATENT DOCUMENTS

| | | |
|---|---|---|
| CH | 687005 | 8/1996 |
| EP | 1375007 | 1/2004 |
| EP | 1637231 | 3/2006 |
| WO | 2004/052550 | 6/2004 |
| WO | 2006/035792 | 4/2006 |

* cited by examiner

*Primary Examiner* — Len Tran
*Assistant Examiner* — Ryan Reis
(74) *Attorney, Agent, or Firm* — Shoemaker and Mattare

(57) ABSTRACT

A shower head comprising a pair of plates, for dispensing and closing, directly facing each other relative to an axial direction. The shower head comprises a closing ring which is directly arranged between the plates and fixing and sealing means suitable for fixing the plate each other and for realizing a liquid tight seal, so as to sealingly delimit with the plates a fluid collecting chamber and dispense the liquid through holes of the delivery plate. The shower head is especially thin, inexpensive to manufacture and to assemble.

6 Claims, 7 Drawing Sheets

SHOWER HEAD

FIELD OF THE INVENTION

The present invention relates to a shower head.

BACKGROUND OF THE INVENTION

Shower heads of the prior art comprise a dispensing plate inserted in a body connected to a hose for receiving inlet water.

However, such heads are cumbersome, expensive and complex to be made and assembled. Moreover, the heads of the prior art are often constructively restricted to circular shapes since usually, the dispensing plate is screwed inside the head body.

SUMMARY OF THE INVENTION

The problem of the present invention is to provide a shower head which solves the disadvantages mentioned with reference to the prior art.

Such disadvantages are solved with a shower head in accordance with claim 1.

BRIEF DESCRIPTION OF THE DRAWINGS

Other embodiments of the shower head according to the invention are described in the subsequent claims.

Further features and the advantages of the present invention will appear more clearly from the following description of preferred non-limiting embodiments thereof, wherein.

DETAILED DESCRIPTION OF THE INVENTION

Figure 2:
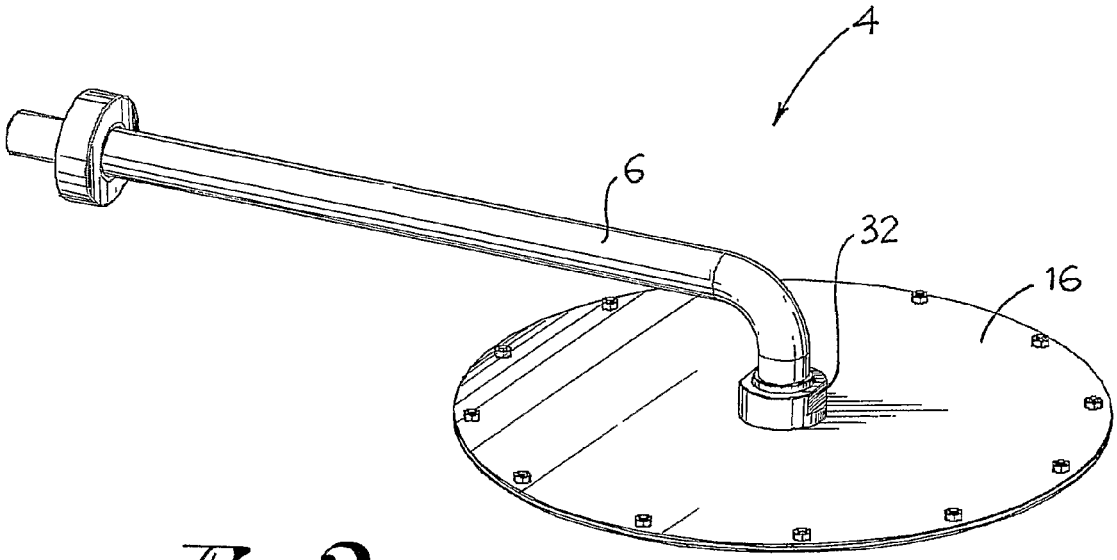
FIG. 2 shows a perspective view of the shower head of FIG. 1, from a different angulation.
Figure 1:
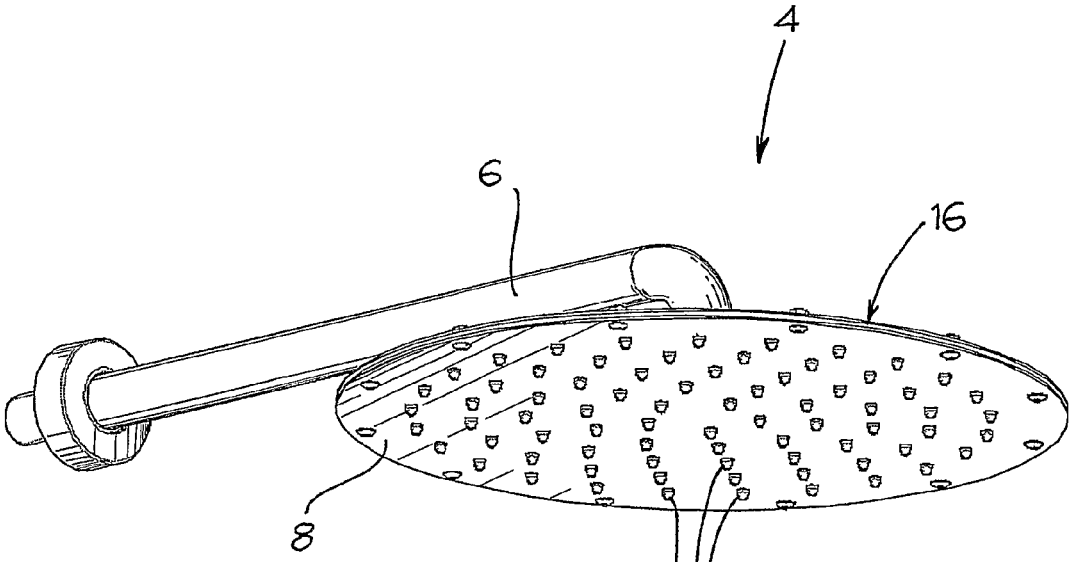
FIG. 1 shows a perspective view of a shower head according to an embodiment of the present invention.
Figure 3:
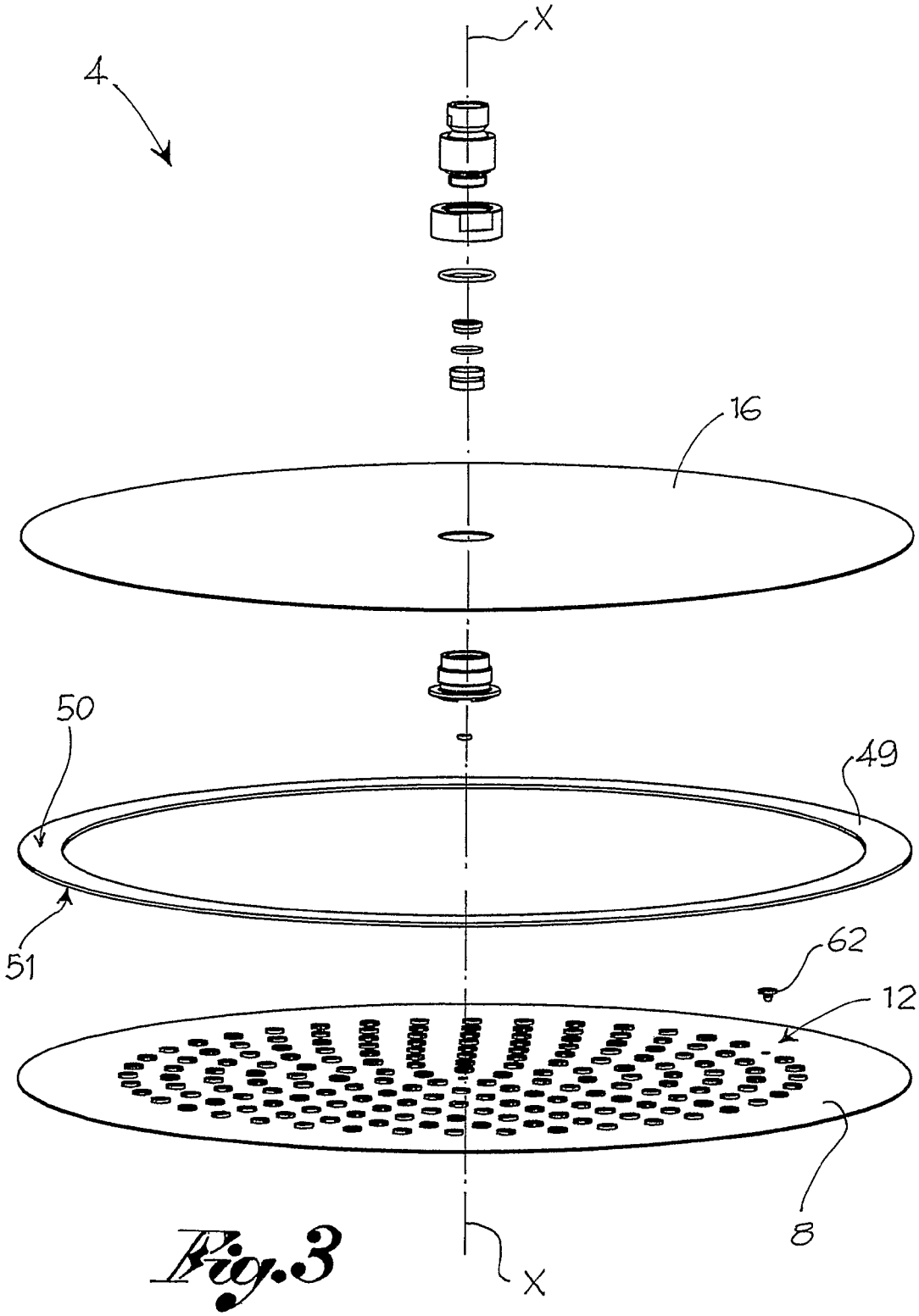
FIG. 3 shows an exploded view of a shower head according to a further embodiment of the present invention.
Figures 4, 5:
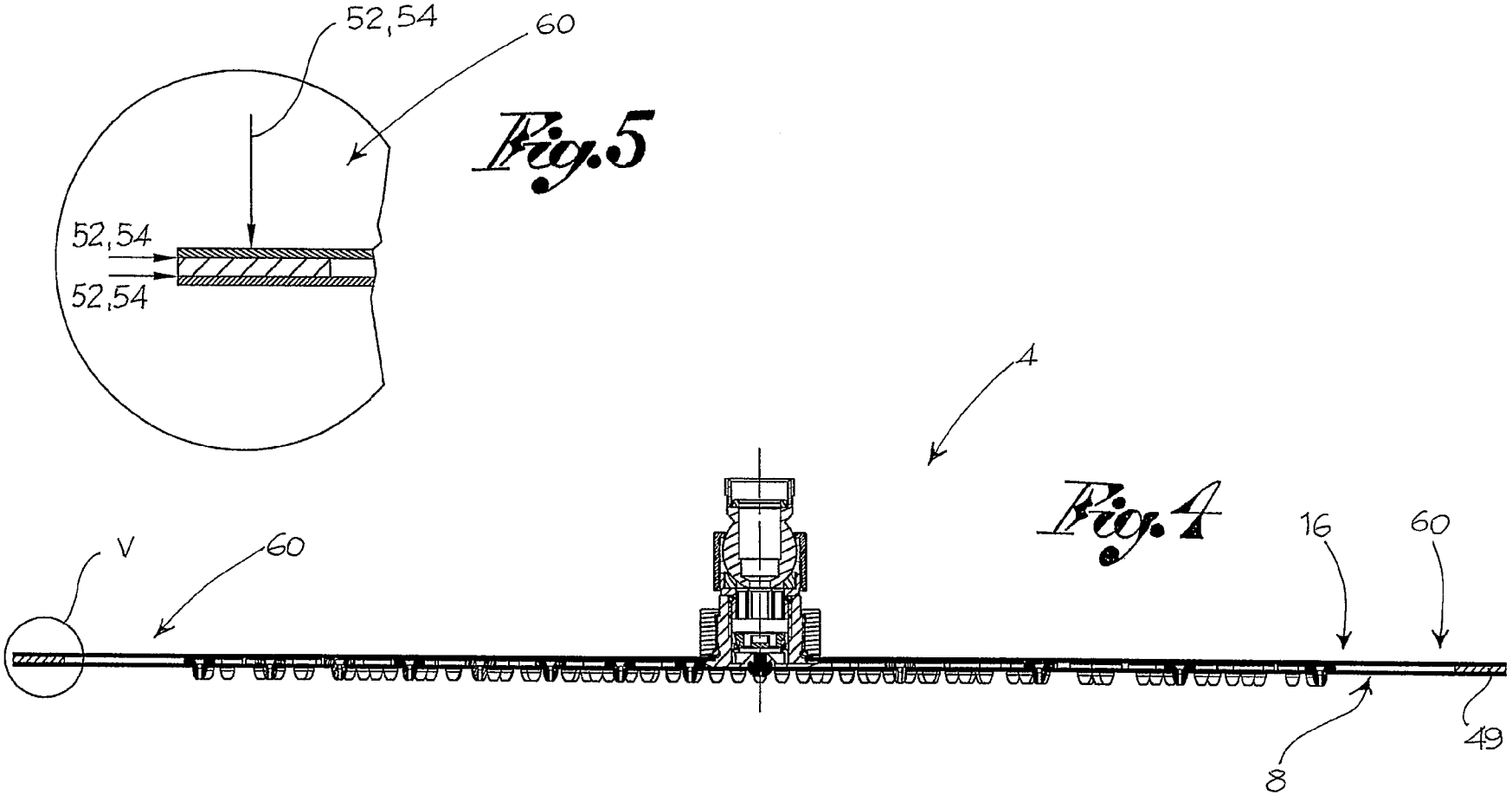
FIG. 4 shows a section view of the shower head of FIG. 3.
FIG. 5 shows a section view of the enlarged detail V of FIG. 4.
Figure 8:
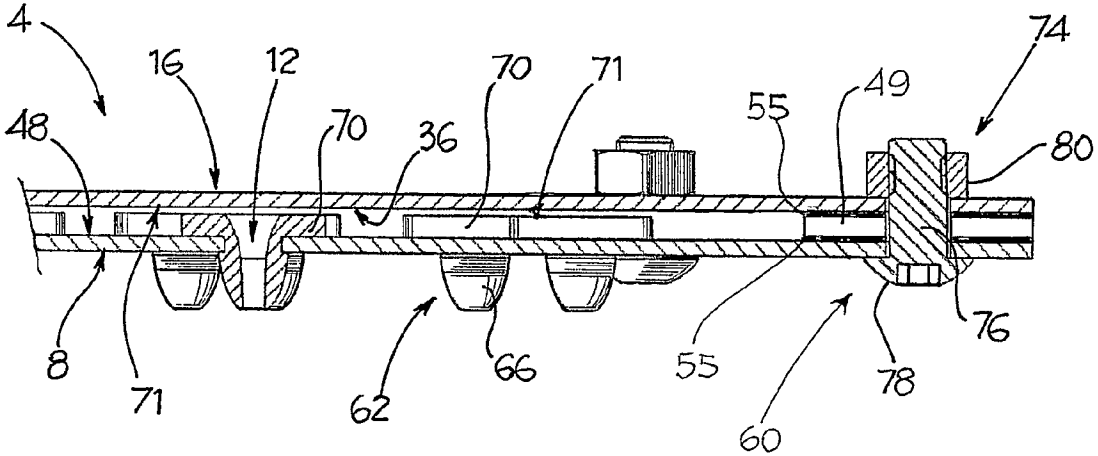
FIG. 8 shows a section view of the shower head of FIG. 6 according to a further embodiment.
Figure 6:
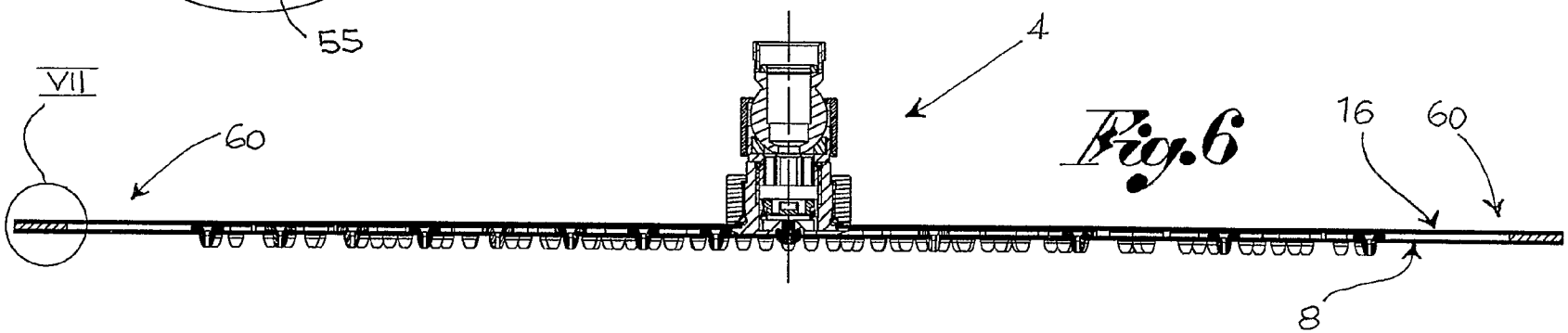
FIG. 6 shows a section view of a shower head according to a further embodiment of the present invention.
Figure 7:
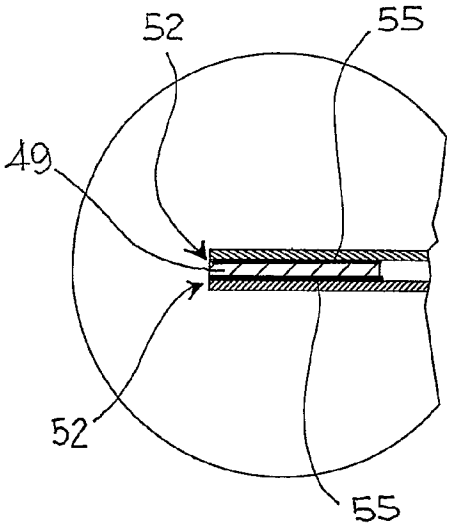
FIG. 7 shows an exploded view of the enlarged detail VII of FIG. 6.
Figure 11:
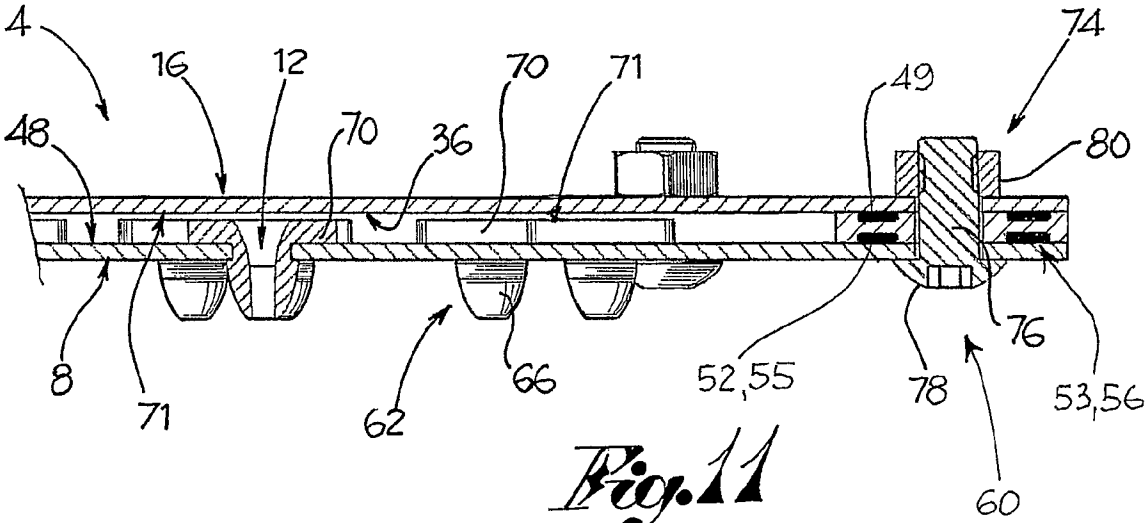
FIG. 11 shows a section view of the shower head of FIG. 9, according to a further embodiment.
Figure 10:
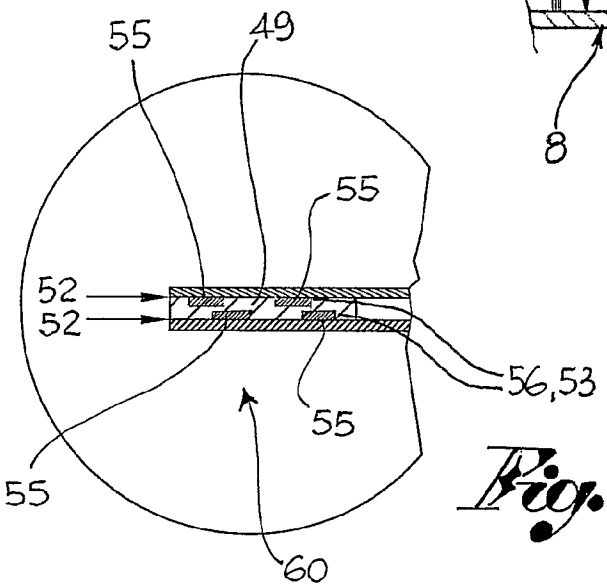
FIG. 10 shows a section view of the enlarged detail X of FIG. 9.
Figure 9:
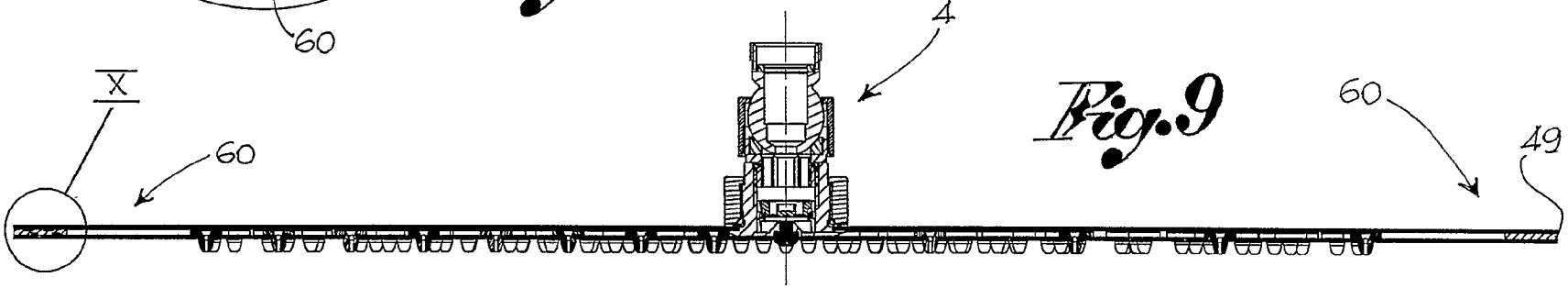
FIG. 9 shows a section view of a shower head according to another embodiment of the present invention.
Figure 12:
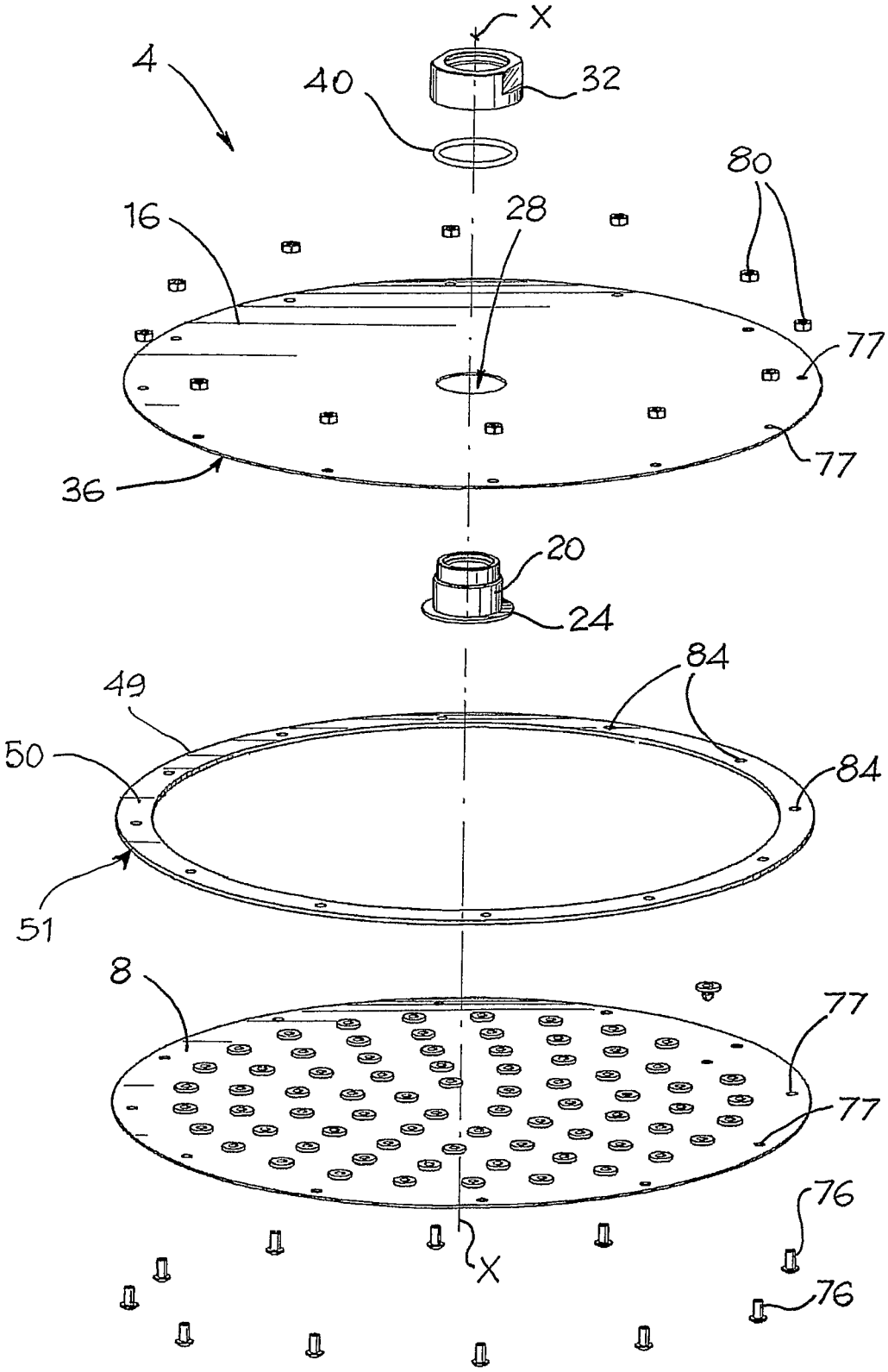
FIGS. 12 and 13 show exploded perspective views of a shower head according to further embodiments of the present invention.
Figure 13:
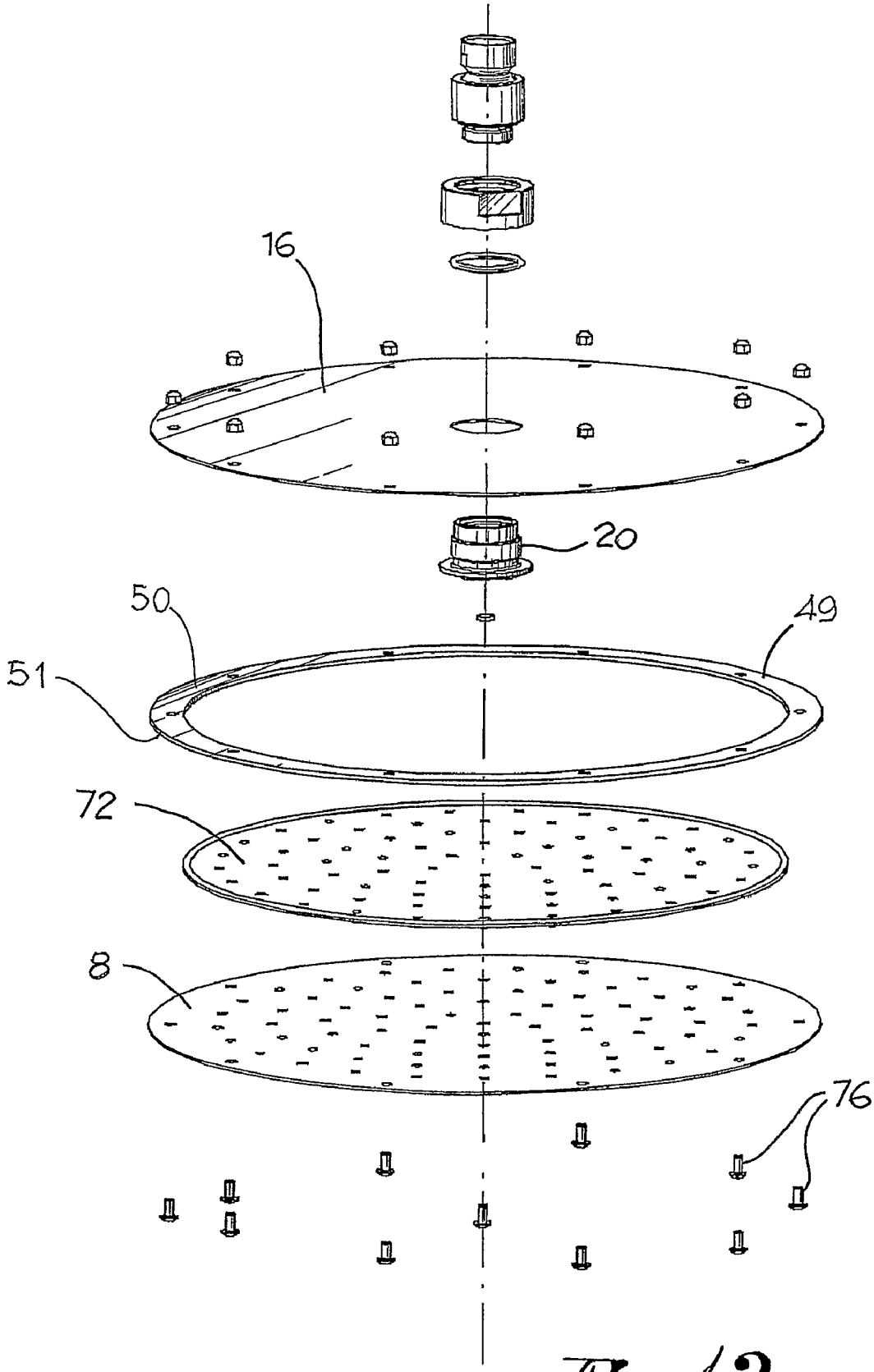

Elements or parts of elements in common between the embodiments described below are referred to with the same reference numerals.

With reference to the above figures, reference numeral 4 generically denotes a shower head, suitable for being connected to a water outlet, for example by a piping 6 or a hose.

According to an embodiment, shower head 4 comprises a dispensing plate 8 provided with at least one dispensing hole

12 for water dispensing. According to an embodiment, the dispensing plate 8 is circular and flat and comprises a plurality of dispensing holes 12 distributed on the surface of the plate itself. According to an embodiment, said dispensing holes 12 are evenly distributed on the dispensing plate 8. The plate shape is not limited to the circular shape but can be of any type, including asymmetrical shapes. The plates may even not be flat.

Shower head 4 further comprises a closing plate 16, in fluid connection with a water outlet, for example by a hollow cylindrical distributor 20, in communication with a water outlet. Distributor 20 is constrained to said closing plate 16 for example by a collar 24 having a diameter greater than an opening 28 of the same plate 16.

Preferably, a ring nut 32 is inserted on distributor 20 so as to influence collar 24 in abutment against an internal surface 36 of the closing plate 16. Ring nut 32 may be screwed on distributor 20 or it may be associated to distributor 20 in other ways, for example by gluing or welding. Preferably, an 'O-ring' 40 or any other means suitable for ensuring a fluid seal is arranged between distributor 20 and ring nut 32.

Advantageously, said plates 8, 16 are directly facing each other, relative to an axial direction X which, according to a possible embodiment, determines a symmetry axis for the same shower head 4. The geometry of plates 8, 16, in any case, is not restricted to axial-symmetric shapes.

Preferably, plates 8, 16 are counter-shaped to one another relative to said axial direction X; in other words, the projections of the profiles or edges of plates 8, 16 relative to the axial direction X overlap. Plates 8, 16, at faces directly facing one another, may be plane and parallel to each other and, according to further embodiments, they may be concave or convex.

Plates 8, 16 may for example be obtained by shearing or cutting from sheet; preferably, if plates 8, 16 are intended to be subject to surface treatments, it is possible to carry out such treatments on the sheets, before carrying out the subsequent cutting or shearing operations. In other words, in order to limit the manufacturing costs, it is possible to treat the sheet in advance with automatic finishing machines, thus minimising the costs due to the unit component treatment.

Advantageously, plates 8, 16 are suitable for sealingly delimit a collecting chamber 48 for dispensing the fluid through holes 12 of the dispensing plate 8.

Preferably, shower head 4 comprises a closing ring 49 arranged between said dispensing and distribution plates 8, 16.

The closing ring 49 comprises two axially opposed faces 50,51, each face directly opposing a relative plate 8,16.

Advantageously, the shower head 4 comprises fixing and sealing means 52, placed between at least one axial face 50,51 of the ring 49 and the respective opposing plate 8,16; fixing and sealing means 52 are suitable for performing both a fixing of the plates relative to each other and a fluid tight seal, in order to sealingly delimit the collecting chamber 48 with the plates 8,16 and to dispense the fluid through holes 12 of the dispensing plate 8.

Preferably, the plates 8,16 have the same external dimensions so as to perfectly overlap with respect to said axial direction X. Preferably, the closing ring 49 is placed coaxially with respect to said axial direction X.

According to an embodiment of the present invention, fixing and sealing means 52 are fixed to the ring 49 and to the plates 8,16 so as to avoid the disassembly of the plates.

According to an embodiment, said fixing and sealing means 52 are radially comprised within the radial thickness of the ring 49.

Preferably, the axial thickness of fixing and sealing means 52 is negligible with respect to the thickness of the plates 8,16 and of the ring 49 so that the overall axial thickness of the shower head 4 is substantially equal to the sum of the axial thickness of the ring 49 and of the plates 8,16.

According to an embodiment, fixing and sealing means 52 are at least partially housed in housings 53 within the ring 49, and particularly in correspondence of the axial faces 50,51 of the ring 49 and/or in correspondence of the plates 8,16 so that the overall axial thickness of the shower head 4 is substantially equal to the sum of the axial thickness of the ring 49 and of the plates 8,16.

According to an embodiment, fixing and sealing means 52 comprise a welding 54 which circumferentially delimits all the collecting chamber of the shower head.

For example, the welding 54 is a radial welding, it is to say a welding performed on the side of the external circumference of the shower head.

According to another embodiment, said welding 54 is an axial welding, it is to say a welding performed on the side of the axial faces 50,51 of the ring 49.

The welding may be a TIG, MIG, MAG welding.

Preferably, the welding 54 is a laser welding.

According to another embodiment, fixing and sealing means 52 comprise a gluing portion 55 which circumferentially delimits all the collecting chamber of the shower head. The gluing may be axial, it is to say performed on the side of the axial faces 50,51 of the ring 49.

According to another possible embodiment, the ring 49 comprises at least one groove, the groove 56 being placed on at least one axial face 50,51 and being suitable for improve an even placing and distribution of glue on the ring 49.

Said groove 56 is for example a circumferential groove.

For example, it is possible to use a silicone glue or an epoxy glue.

Preferably, in an assembly configuration, plates 8, 16 determine a collecting chamber 48 having a decreasing axial thickness between a central portion 58 and a peripheral portion 60 of shower head 4, relative to the axial direction X. At the central portion 58, distributor 20 also carries out the function of spacer in order to create an axial thickness of the collecting chamber 48 which should be larger on the central portion 58 and decreasing towards the peripheral portion 60.

Preferably, the closing ring 49 is substantially stiff at least in an axial direction so as to form an end of stroke in the approach between the plates during the shower head assembly step. The closing ring also ensures a minimum thickness of the collecting chamber so as to always ensure a water flow towards the dispensing holes 12.

According to an embodiment, shower head 4 comprises nozzles 62 suitable for being partly inserted in holes 12 of the dispensing plate 8.

Nozzles 62 comprise a dispensing portion 66 projecting from the dispensing plate 8 and a stopping portion 70 suitable for forming a stop in the introduction of nozzles 62 into the relevant holes 12.

Preferably, the axial thickness of said stopping portion 70 is smaller than the thickness of said closing ring 49, so that following the axial closing of the dispensing and distribution plates 8, 16, an air space 71 is formed between the stopping portion 70 and the closing portion 16, air space 71 being suitable for allowing the water flow through nozzles 62.

Nozzles 62 are for example made of rubber or any other material suitable for being elastically deformed for breaking scale deposits, so as to favour the operation for cleaning the nozzles, as well as the removal of any scale built thereon.

According to an embodiment, the shower head 4 comprises a membrane 72 integrally provided with said nozzles 62. In other words, shower head 4 comprises a membrane 72, preferably made of rubber, which integrally comprises a plurality of nozzles 62.

The dispensing 8 and distribution 16 plates may be axially constrained to each other in compression, for example by screw connecting means 74 or by any other means suitable for constraining the two plates 8, 16 into position so as to keep seal 44 in an axial compression status.

The screw connecting means 74 for example comprise a screw 76 passing through connecting holes 77 obtained on plates 8, 16, preferably at the peripheral portion 60 of the same.

Screw 76 comprises an opposite head 78 in abutment on one of said plates 8, 16, and having such length as to cross the plates and protrude on the opposite side so as to be constrained, on the other plate 16, 8, by a nut 80.

Preferably, the screw connecting means 74 are arranged on a portion of said plates radially external relative to said collecting chamber 48; in other words, the screw connecting means 74 do not axially cross the collecting chamber 48.

According to a preferred embodiment, the screw connecting means 74 are inserted through fixing holes 84 obtained on a peripheral portion of the closing ring 49, so as to lock said ring 49 into position relative to plates 8, 16.

The screw connecting means 74 may be applied both to embodiments comprising the gluing of the plates 8,16 ands to embodiments comprising the welding of the plates.

As we can appreciate from the description, the shower head of the present invention allows overcoming the disadvantages exhibited by the shower heads of the prior art.

In particular, the shower head according to the invention exhibits assembly easiness and inexpensiveness.

As seen, the plates may be simply obtained by shearing from sheet or also for example by laser cutting. It is therefore possible to manufacture plates having any shape, even asymmetric.

In other words, unlike the shower heads of the prior art, which are restricted to few configurations of simple shape, the shower head according to the present invention allows creating complex shapes, using a production technology that requires no investments in expensive equipment like moulds, specific tools or else. Complex shapes can be manufactured in small batches at low cost. With the same shearing or cutting operations it is at the same time possible to make counter-shaped seals relative to the plates.

Moreover, it is possible to carry out the optional sheet polishing before the subsequent shearing or cutting so as to avoid carrying out the subsequent surface finishing processes on the single plates. In other words, it is possible to treat the sheet in advance with automatic finishing machines, thus minimising the costs due to the unit component treatment.

Moreover, the shower head exhibits very small overall dimensions. For example, it is possible to manufacture a shower head having an axial thickness, intended as overall thickness or distance between the plates, equal to about 4 mm.

The shower heads of the prior art do not allow achieving such small thicknesses.

The water flow between the plates, that is, the axial thickness of the collecting chamber, may advantageously range from a value of about 3.5 mm, for example at a central portion of the shower head, to a value of about 2 mm, at the radial periphery of the shower head. In this way, the even water distribution through all the holes of the distribution plate is favoured; in particular, it is possible to reduce the axial thickness of the collecting chamber moving from the central portion to the peripheral portion, so as to ensure a pressure evenness also on the outermost dispensing holes.

Moreover, the shower heads according to the present invention may be made in any shape. In fact, the cut or sheared sheets may even have asymmetrical shapes since the plates are not associated to one another by screwing.

The assembly of the plates may be performed both by gluing and by welding.

The welding gives the possibility to perform a secure connection of the plates which avoids the separation of the plates and at the same ensures liquid tight seal. The welding ensures that the thickness of the shower head does not change and remains substantially equal to the sum of the thickness of the plates and the closing ring.

The welding ensures a precise assembly of the plates and gives the possibility to assemble very thin plates. The welding ensures a high automation in the production of the shower head; for example a laser welding is very advantageous because the same machine laser head may be used both for cutting the plates from a metal sheet and for performing the subsequent welding.

The welding requires a reduced thermal energy so as not to deform the thin sheets; it is possible to perform an autogenous welding, it is to say without using a deposit metal, in order to limit the axial dimension of the shower head.

The gluing gives the possibility to rapidly and cheaply assembly the plates. The glue can ensure the liquid tight seal and can oppose to the axial forces acting of the plates because of water pressure. According to an embodiment it is possible to use both gluing and screw connecting means which have the task of opposing the axial forces acting between the plates; in this way the glue has the task of liquid seal and the screws have the task of fixing the plates.

Thanks to the grooves on the closing ring, the deposition of the glue is uniform so as to grant both liquid seal and a constant and reduced thickness of the glue layer.

A man skilled in the art may make several changes and adjustments to the shower heads described above in order to meet specific and incidental needs, all falling within the scope of protection defined in the following claims.

The invention claimed is:

1. A shower head consisting of:

a dispensing plate having an array of holes for dispensing water, a plurality of nozzles, each installed in a respective one of said holes, a closing plate, directly facing the dispensing plate in an axial direction, a closing ring directly arranged between said dispensing and closing plates, said ring having two opposite axial faces, each face engaging a respective one of said plates, said dispensing plate, closing plate, and closing ring having the same outside diameter and being connected at their outer peripheries by welding or gluing so as to define a closed chamber for liquid between said plates, wherein the axial spacing between the plates decreases from the center of the plates to their periphery, and further comprising a fitting in said closing plate for admitting water from a water source into said chamber.

2. A shower head according to claim 1, wherein the axial thickness of the welding or gluing is negligible with respect to the thickness of the plates and of the ring so that the overall axial thickness of the shower head is substantially equal to the sum of the axial thickness of the ring and of the plates.

3. A shower head according to claim 1, wherein said nozzles comprise a dispensing portion projecting from the dispensing plate and a stopping portion for retaining the nozzles in their respective holes.

4. A shower head according to claim 3, wherein said nozzles are formed integral with a membrane.

5. A shower head according to claim 1, wherein the plates and the closing ring have an assembled thickness not greater than 4 mm.

6. A show head according to claim 1, wherein said plates and said closing ring are interconnected only by welding.

* * * * *